US011091856B2

(12) United States Patent
Hsu et al.

(10) Patent No.: US 11,091,856 B2
(45) Date of Patent: Aug. 17, 2021

(54) ELECTRIC HEATING CLOTH HAVING GAPS AND CONNECTION STRUCTURE THEREOF

(71) Applicant: Bumblebee Tech Co., Ltd., Victoria (SC)

(72) Inventors: Chung-Yeh Hsu, New Taipei (TW); Tzu-Chin Hsu, New Taipei (TW); Yie-Yeh Hsu, New Taipei (TW)

(73) Assignee: Bumblebee Tech Co., Ltd., Mahe (SC)

( * ) Notice: Subject to any disclaimer, the term of this patent is extended or adjusted under 35 U.S.C. 154(b) by 424 days.

(21) Appl. No.: 16/167,750

(22) Filed: Oct. 23, 2018

(65) Prior Publication Data

US 2019/0127894 A1 May 2, 2019

Related U.S. Application Data

(60) Provisional application No. 62/577,720, filed on Oct. 27, 2017.

(51) Int. Cl.

| | |
|---|---|
| ***H05B 3/34*** | (2006.01) |
| ***D02G 3/44*** | (2006.01) |
| ***D02G 3/04*** | (2006.01) |
| ***D02G 3/12*** | (2006.01) |
| ***D03D 15/00*** | (2021.01) |
| *A47G 9/02* | (2006.01) |
| *D02G 3/38* | (2006.01) |

(52) U.S. Cl.

CPC ..... *D02G 3/441* (2013.01); *D02G 3/04* (2013.01); *D02G 3/12* (2013.01); *D03D 15/00* (2013.01); *H05B 3/347* (2013.01); *A47G 9/0215* (2013.01); *D02G 3/38* (2013.01); *D10B 2101/20* (2013.01); *D10B 2401/16* (2013.01); *D10B 2403/03* (2013.01); *H05B 2203/011* (2013.01); *H05B 2203/015* (2013.01); *H05B 2203/016* (2013.01); *H05B 2203/036* (2013.01)

(58) Field of Classification Search

None

See application file for complete search history.

(56) References Cited

U.S. PATENT DOCUMENTS 3,424,362 A * 1/1969 Morey ..... F24D 13/02 228/5.1
3,946,194 A * 3/1976 de la Bretonieri .... H05B 3/342 219/213
4,538,054 A * 8/1985 de la Bretoniere ..... D03D 1/00 219/545

(Continued)

FOREIGN PATENT DOCUMENTS

CN 102450895 A 5/2012

*Primary Examiner* — Joseph M. Pelham

(74) *Attorney, Agent, or Firm* — Rosenberg, Klein & Lee

(57) ABSTRACT

An electric heating cloth having gaps and a connection structure thereof are disclosed. The electric heating cloth having gaps comprises plural conductive yarns arranged in a first direction and plural textile yarns and plural metal conductive wires arranged in a second direction for interweaving with the plural conductive yarns. The plural metal conductive wires are aligned at external sides of the plural textile yarns to form a first conductive side and a second conductive side respectively, and each of the first conductive side and the second conductive side has plural gaps.

8 Claims, 9 Drawing Sheets

(56) References Cited

U.S. PATENT DOCUMENTS

| | | | | | |
|---|---|---|---|---|---|
| 5,159,176 | A * | 10/1992 | Sherrer | H05B 3/34 | 219/213 |
| 5,298,722 | A * | 3/1994 | Tanaka | H05B 3/36 | 219/202 |
| 5,422,462 | A * | 6/1995 | Kishimoto | H05B 1/0272 | 219/529 |
| 5,484,983 | A * | 1/1996 | Roell | D04B 1/12 | 219/528 |
| 5,994,669 | A * | 11/1999 | McCall | H01M 10/6571 | 219/209 |
| 6,049,063 | A * | 4/2000 | Barber | H05B 3/56 | 219/213 |
| 2002/0153368 | A1* | 10/2002 | Gardner | B32B 17/04 | 219/545 |
| 2004/0262294 | A1* | 12/2004 | Horey | H05B 3/342 | 219/545 |
| 2007/0068931 | A1* | 3/2007 | Augustine | A61B 46/00 | 219/549 |
| 2007/0210074 | A1* | 9/2007 | Maurer | B60N 2/5685 | 219/549 |
| 2008/0135120 | A1* | 6/2008 | Seo | H05B 3/347 | 139/35 |
| 2011/0047957 | A1* | 3/2011 | Richard | D03D 15/00 | 57/236 |
| 2011/0278282 | A1* | 11/2011 | Kato | H05B 3/342 | 219/529 |
| 2016/0367051 | A1* | 12/2016 | Chi-Hsueh | A47G 9/086 | |
| 2017/0073853 | A1* | 3/2017 | Chi-Hsueh | D02G 3/385 | |
| 2018/0323483 | A1* | 11/2018 | Hsu | H01M 10/6571 | |

* cited by examiner

ELECTRIC HEATING CLOTH HAVING GAPS AND CONNECTION STRUCTURE THEREOF

BACKGROUND OF THE INVENTION

1. Field of the Invention

The present invention relates to an electric heating cloth having gaps and a connection structure thereof which has effects of saving electricity.

2. Description of Related Art

In manufacturing textiles as functional clothing, sleeping bags or quilts, characteristics of cloth materials or structures of the textiles are all important factors affecting warming effect. In addition to intrinsic properties of a cloth material, heating elements, e.g. electric heating elements, are also introduced into a textile to produce textiles having warming effects after electrifying. Reducing electricity consumption and enhancing safety of a textile having electric heating elements are major research and developmental goals. The China Patent Publication No. CN 102450895 (A), issued on 16 May 2012, disclosed an electric blanket with over-temperature automatic power off function. It comprises a blanket, plural electric heating wires, a temperature controlling switch connected to the plural electric heating wires, and plural temperature transmitters. The plural electric heating wires are fixed and distributed inside the blanket at a specific density, and the plural temperature transmitters are distributed on the blanket. The temperature controlling switch comprises a temperature detection chip in its interior. The temperature transmitters are turned on when the electric blanket with over-temperature automatic power off function is in use, and sends an alarm signal automatically when a local temperature is higher than an alert temperature. If the alarm signal is not processed manually, the electric blanket with over-temperature automatic power off function will automatically shut down for saving electricity and safety. However, if the temperature transmitters of the electric blanket with over-temperature automatic power off function cannot operate properly, the temperature of the electric blanket cannot be regulated effectively.

SUMMARY OF THE INVENTION

The present invention relates to an electric heating cloth having gaps and a connection structure thereof. The electric heating cloth having gaps comprises plural conductive yarns arranged in a first direction and plural textile yarns and plural metal conductive wires arranged in a second direction. The plural metal conductive wires are aligned at external sides of the plural textile yarns to form a first conductive side and a second conductive side respectively, and each of the first conductive side and the second conductive side has plural gaps. Further, a connection structure of the plural electric heating cloths having gaps comprises a fixing lining cloth and at least two electric heating cloths having gaps electrically connecting together in series or in parallel.

According to an embodiment of the present invention, the first conductive side has an odd number of gaps, and the second conductive side has an even number of gaps.

According to an embodiment of the present invention, each of the plural conductive yarns comprises a plurality of filaments and a fine metal filament winding around the plurality of filaments.

According to an embodiment of the present invention, each of the plural conductive yarns comprises a plurality of filaments, a fine metal filament winding around the plurality of filaments in a first direction, and a bundle of non-conductive filaments having a diameter ranging from 0.01 mm to 0.12 mm and winding around the plurality of filaments in a second direction opposite to the first direction, wherein the plurality of filaments and the bundle of non-conductive filaments are made of a plurality of non-conductive long fibers, a plurality of non-conductive short fibers or a plurality of non-conductive blending fibers comprising long fibers and short fibers, wherein the plurality of non-conductive long fibers, the plurality of non-conductive short fibers, or the plurality of non-conductive blending fibers are synthetic fibers including nylon, olefin, acrylic fiber, polyester fiber, spandex, polyethylene terephthalate fiber, Orlon, Dacron, polyetherketone fiber, aromatic polyamide fiber, protein fiber, elastic fiber, carbon fiber and glass fiber.

According to an embodiment of the present invention, the fine metal filament is made of gold, silver, copper, tungsten, lead, zinc, aluminum, nickel, platinum, palladium, titanium, zirconium, tantalum, molybdenum or an alloy material, wherein the alloy material comprises copper zinc alloy, phosphor bronze, molybdenum alloy, copper nickel alloy, copper nickel zinc alloy, copper nickel silicon alloy, copper nickel tin alloy, copper chromium alloy, copper silver alloy, nickel chromium alloy, beryllium copper alloy, copper tungsten alloy, titanium alloy, nickel chromium molybdenum tungsten alloy, tungsten alloy, zirconium alloy, nickel alloy or stainless steel, wherein the fine metal filament has a diameter ranging from 0.01 mm to 0.12 mm.

According to an embodiment of the present invention, a power supply is further provided to electrically connect to the electric heating cloth having gaps.

According to an embodiment of the present invention, the power supply is connected to a temperature controlling element to regulate temperature of the electric heating cloth having gaps.

According to an embodiment of the present invention, each of the plural gaps is provided with an insulation element, and an area of the insulation element is larger than an area of each of the plural gaps.

Accordingly, the electric heating cloth having gaps and the connection structure having the plural gaps at external sides of the plural textile yarns have increased resistance to heat the electric heating cloth having gaps and achieve effects of saving electricity.

DETAILED DESCRIPTION OF THE PREFERRED EMBODIMENT

To provide a thorough understanding, the purpose and advantages of the present invention will be described in detail with reference to the accompanying drawings.

Figure 1:
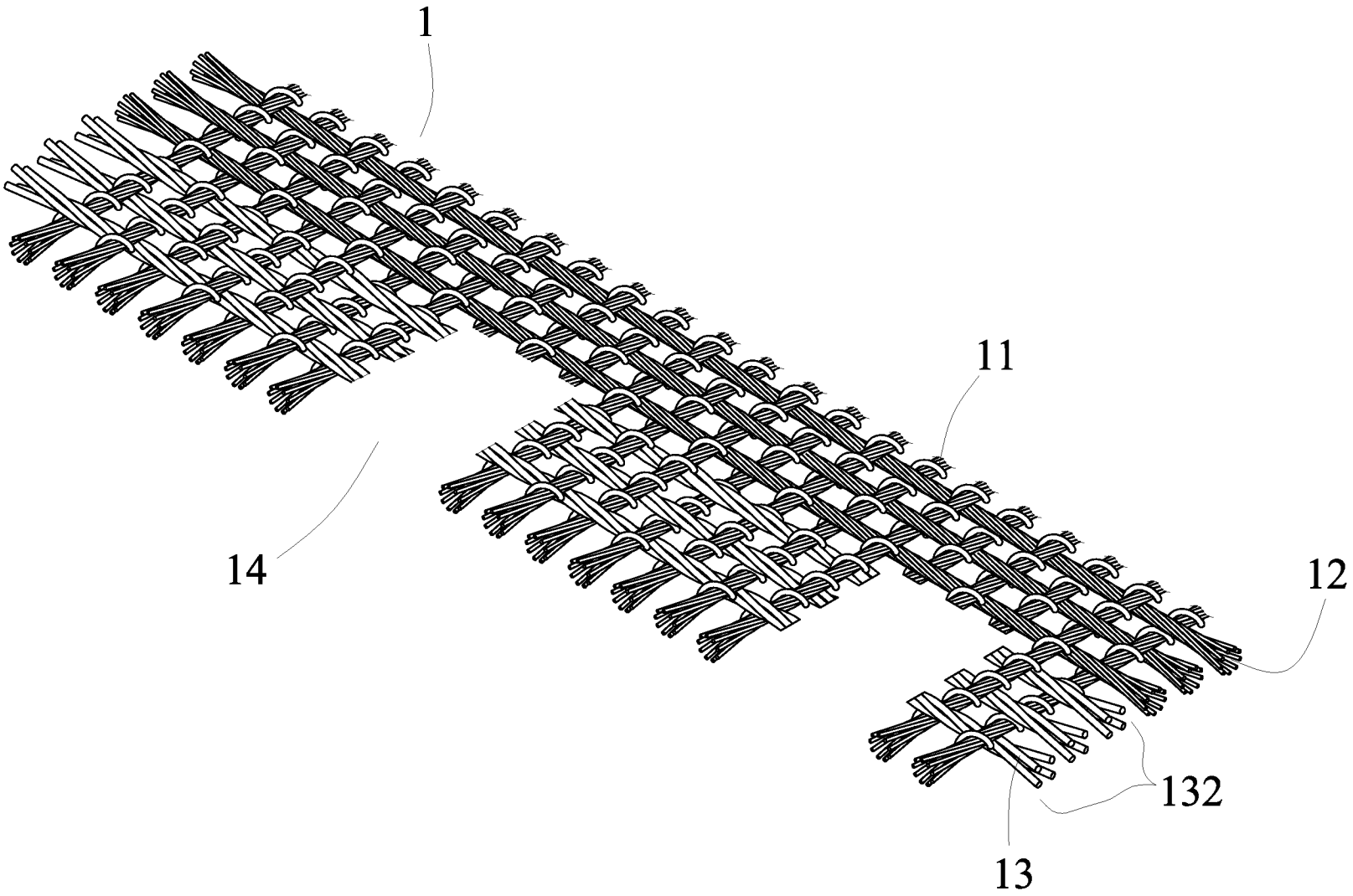
FIG. 1 is a schematic diagram showing plural gaps at a conductive side of an electric heating cloth having gaps of the present invention.
Figure 2:
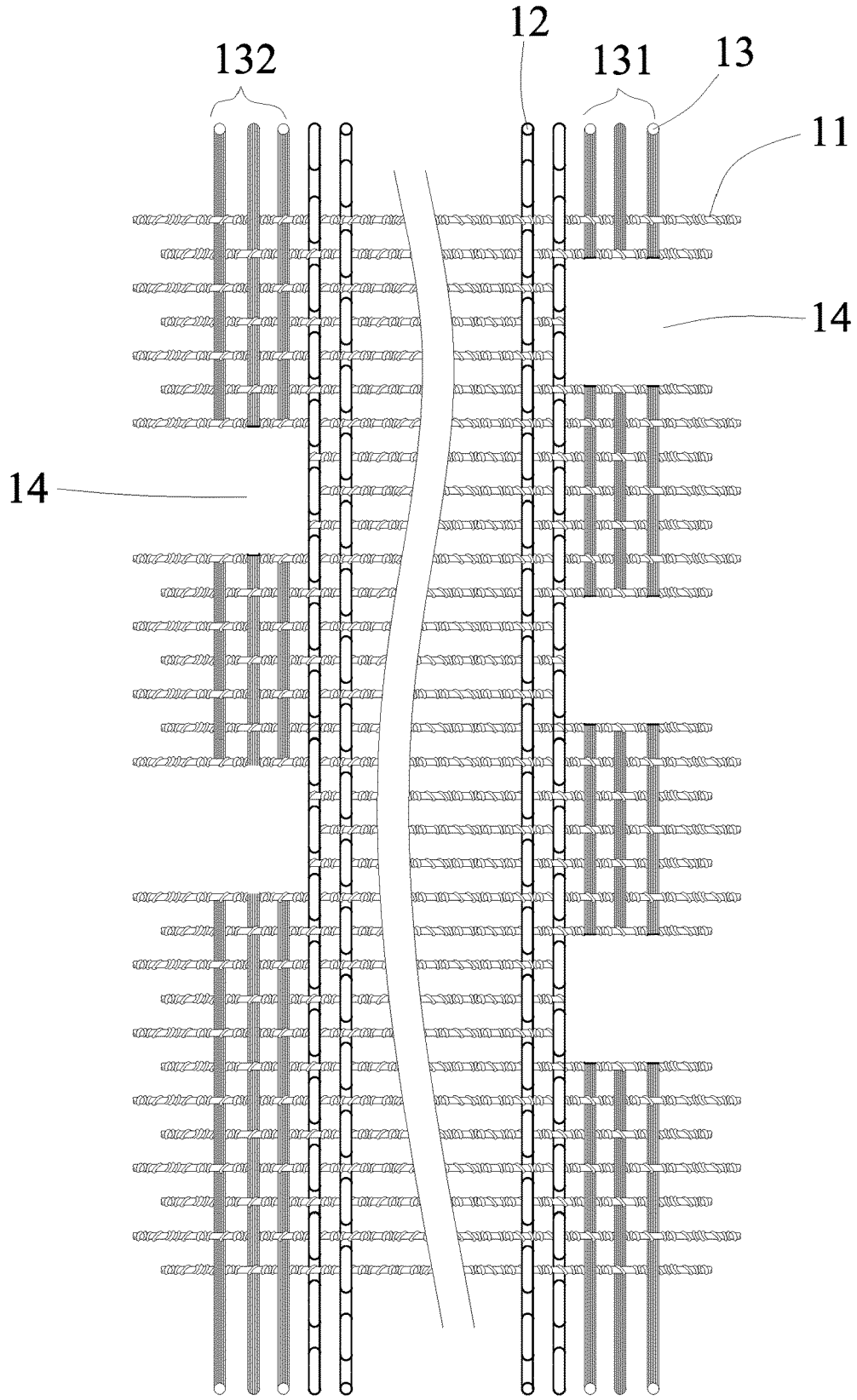
FIG. 2 is a schematic diagram showing a textile pattern of an electric heating cloth having gaps of the present invention.

Referring to FIG. 1 and FIG. 2 showing partial schematic diagrams of an electric heating cloth (1) having gaps (14) of the present invention. The electric heating cloth (1) having gaps (14) comprises plural conductive yarns (11) arranged in a first direction and plural textile yarns (12) and plural metal conductive wires (13) arranged in a second direction for interweaving with the plural conductive yarns (11) to from the electric heating cloth (1) having gaps (14), e.g., the plural conductive yarns (11) are used as wefts and the plural textile yarns (12) and the plural metal conductive wires (13) are used as warps for interweaving to obtain the electric heating cloth (1) having gaps (14) of the present invention. The plural metal conductive wires (13) are aligned at external sides of the plural textile yarns (12) to form a first conductive side (131) and a second conductive side (132) respectively, and each of the first conductive side (131) and the second conductive side (132) has plural gaps (14).

Figure 3:
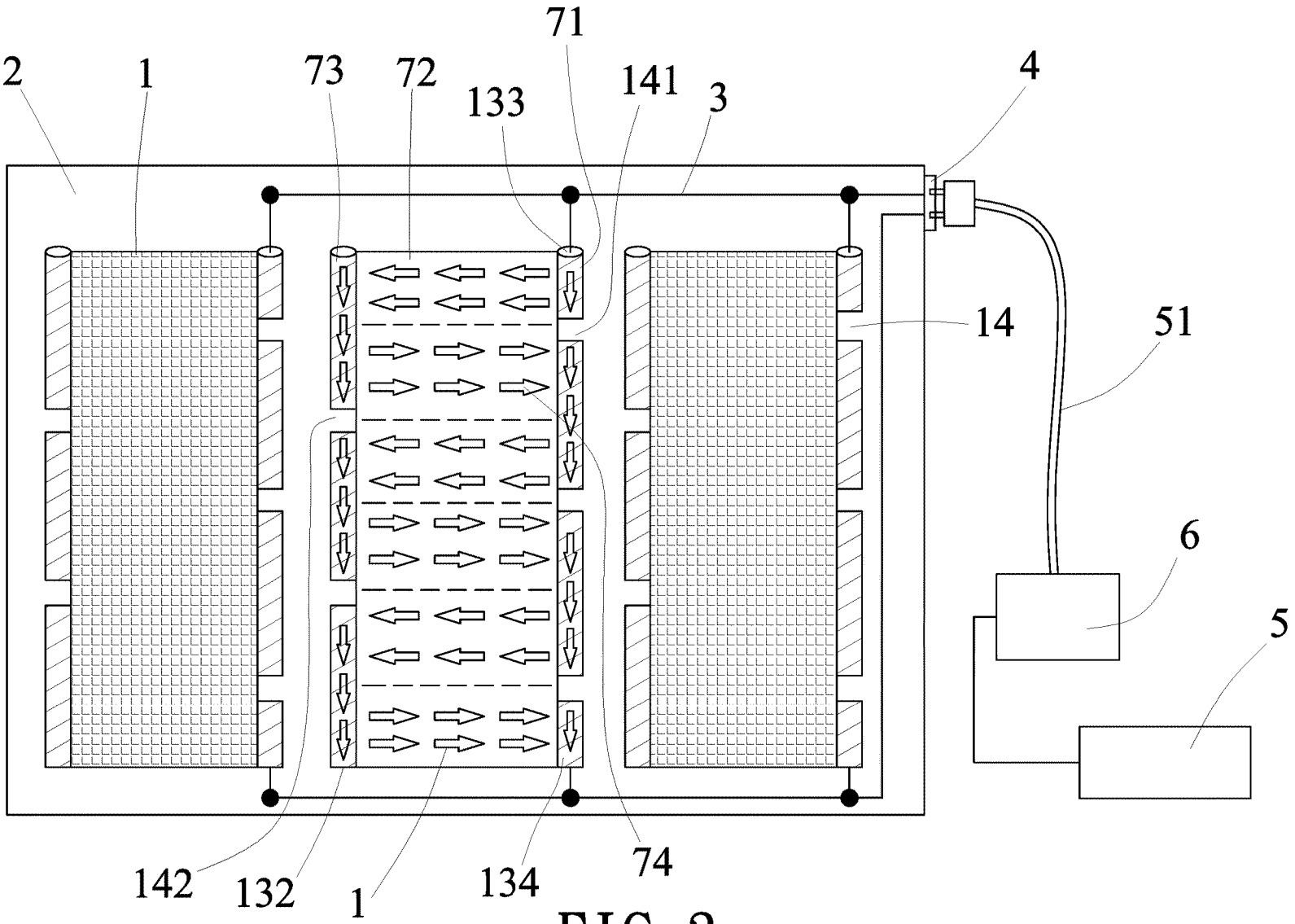
FIG. 3 is a schematic diagram showing three electric heating cloths having gaps connected in parallel.

Referring to FIG. 3, plural electric heating cloths (1) having gaps (14) are disposed at on side of a fixing lining cloth (2), and the plural electric heating cloths (1) having gaps (14) are electrically connecting together in series or in parallel. In FIG. 3, the plural electric heating cloths (1) having gaps (14) are electrically connected in parallel by plural wires (3), and then the plural electric heating cloths (1) having gaps (14) connecting together are connected to a connection port (4) by the wire (3) for forming a circuit. The connection port (4) can be fixed at the fixing lining cloth (2) or disposed outside the fixing lining cloth (2). The connection port (4) of the present invention is further connected with a power supply (5) by an export wire (51) for transmitting electricity to each of the plural electric heating cloths (1) having gaps (14) by the wires (3) and warming the plural electric heating cloths (1) having gaps (14). The power supply (5) is further connected to a temperature controlling element (6) to regulate electricity exported from the power supply (5) and the temperature of the electric heating cloth (1) having gaps (14). The power supply (5) can be a direct current (DC) power supply or an alternating current (AC) power supply which provides voltages ranging from 3 volts to 48 volts. The temperature controlling element (6) regulates voltage, electrical current, temperature and operation time of the power supply (5) for further regulating the temperature of the electric heating clothe cloth (1) having gaps (14). The temperature of the electric heating cloth a) having gaps (14) is ranging from 0° C. to 75° C., e.g. 10° C., 30° C. and 65° C. The present invention can be further provided with two outer cloths for wrapping the fixing lining cloth (2) and the at least one electric heating cloth a) having gaps (14) fixed thereon, the two outer cloths are made of a windproof cloth or a waterproof cloth.

Figure 4:
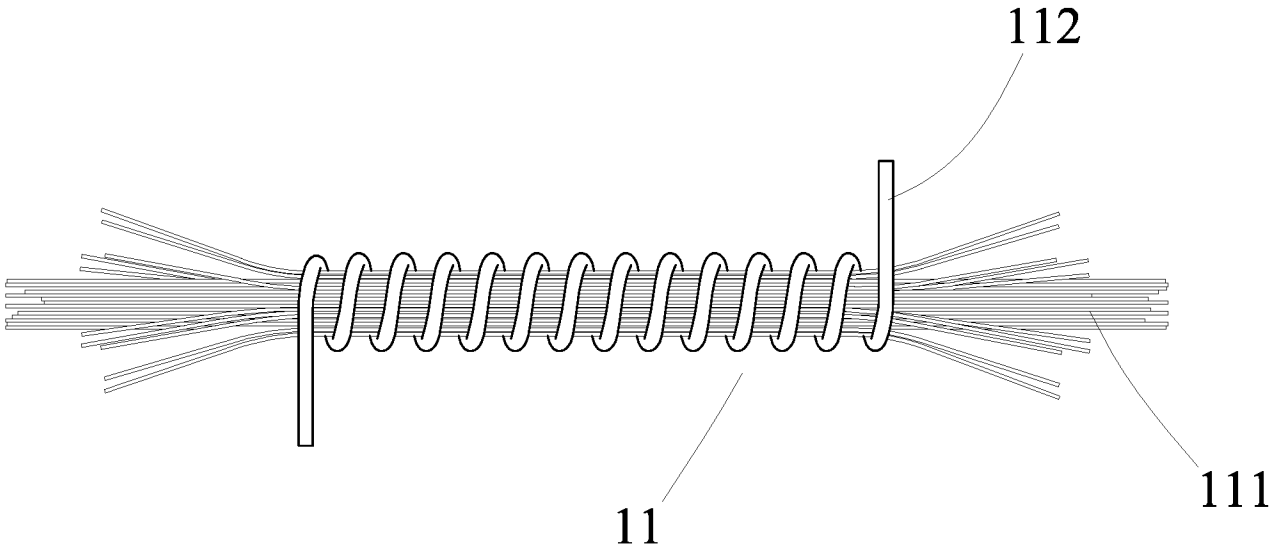
FIG. 4 is a first stereogram showing a conductive yarn of an electric heating cloth having gaps of the present invention.
Figure 5:
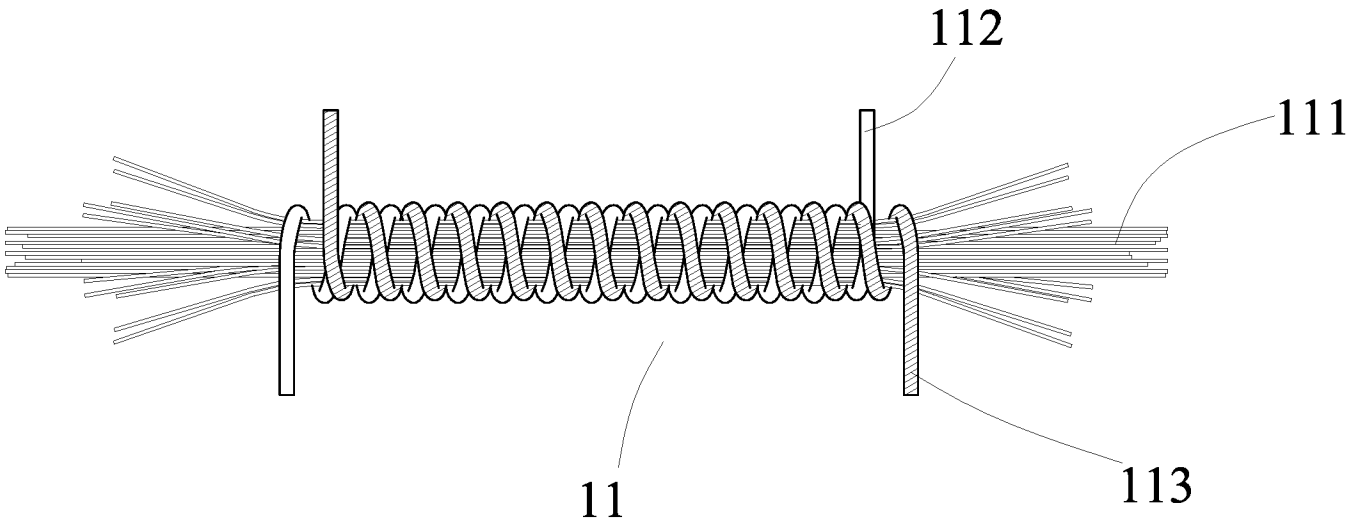
FIG. 5 is a second stereogram showing a conductive yarn of an electric heating cloth having gaps of the present invention.

Referring to FIG. 4, in one embodiment of the present invention, each of the plural conductive yarns (11) comprises a plurality of filaments (111) and a fine metal filament (112) winding around the plurality of filaments (111). Referring to FIG. 5, in another embodiment of the present invention, each of the plural conductive yarns (11) comprises a plurality of filaments (111), a fine metal filament (112) winding around the plurality of filaments (111) in a first direction, and a bundle of non-conductive filaments (113) winding around the plurality of filaments (111) in a second direction opposite to the first direction for preventing the fine metal filament (112) from shedding, breaking or shifting and strengthen the structure of the electric heating cloth (1) having gaps (14). The diameter of the bundle of non-conductive filaments (113) is preferably ranging from 0.01 mm to 0.12 mm. The ratio of the density of the fine metal filament (112) winding around the plurality of filaments (111) to the density of the bundle of non-conductive filaments (113) winding around the plurality of filaments (111) can be 1:1, 1:2 and 1:3.

Figure 6:
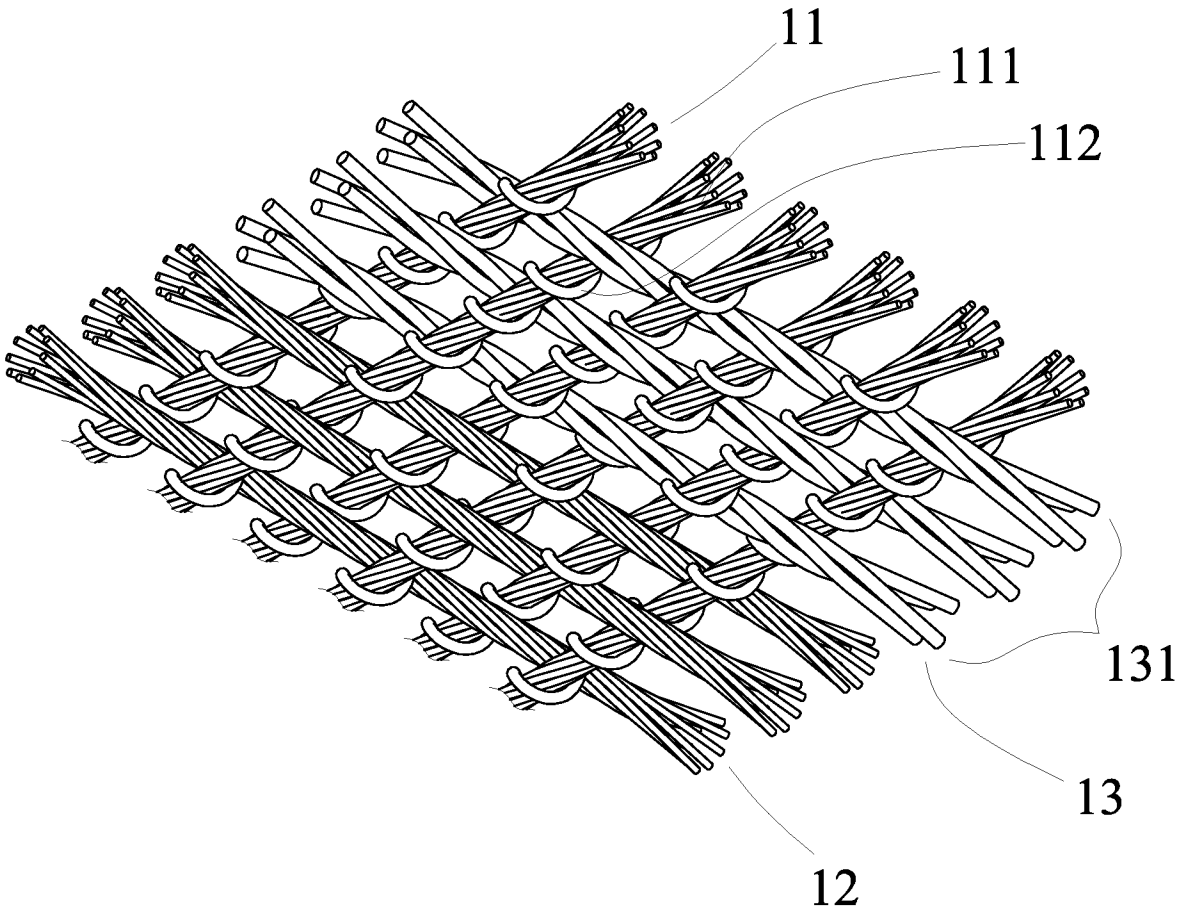
FIG. 6 is a stereogram showing a textile pattern of an electric heating cloth having gaps of the present invention.
Figure 7:
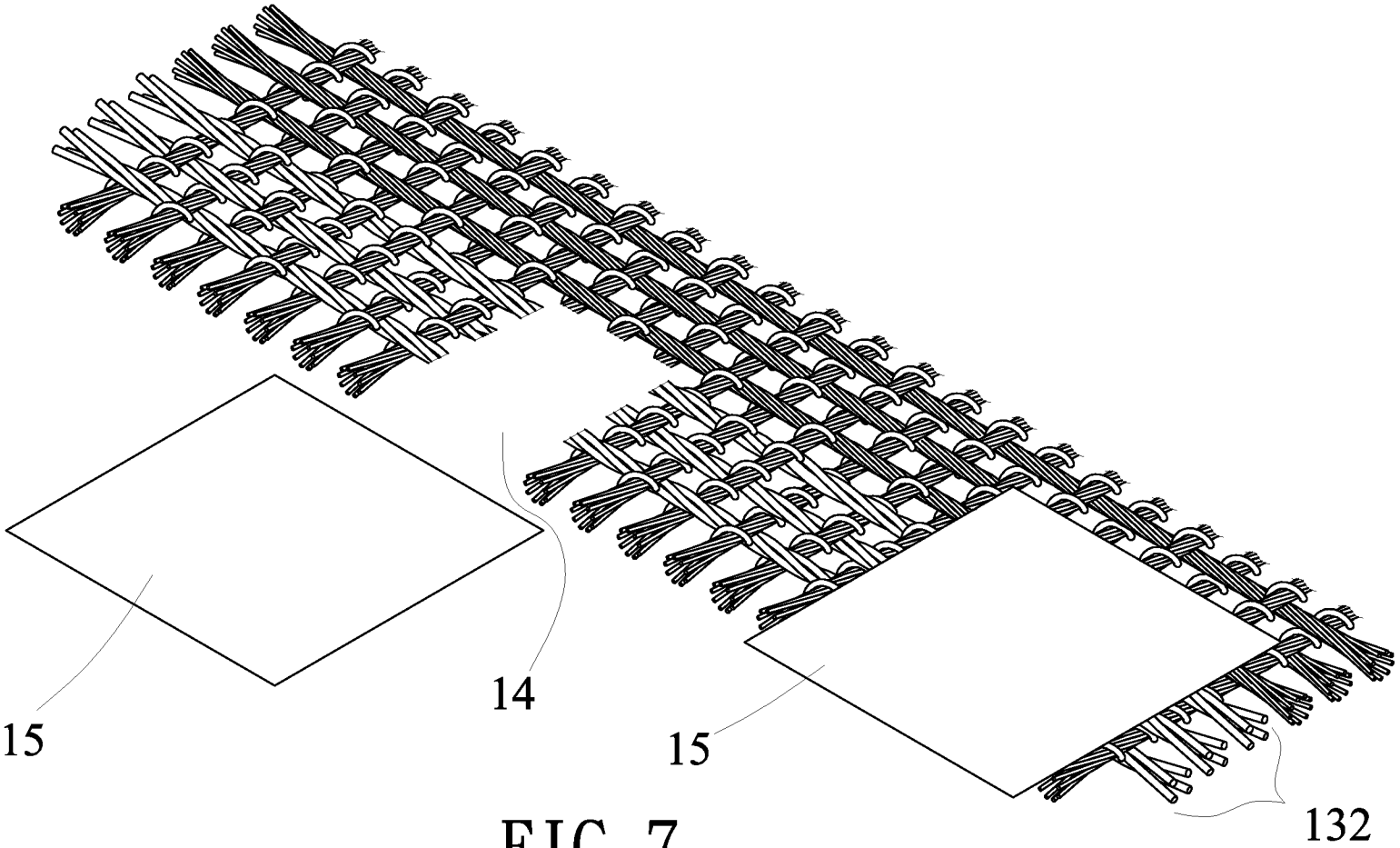
FIG. 7 is a first schematic diagram showing insulation elements disposed at plural gaps of an electric heating cloth having gaps.
Figure 8:
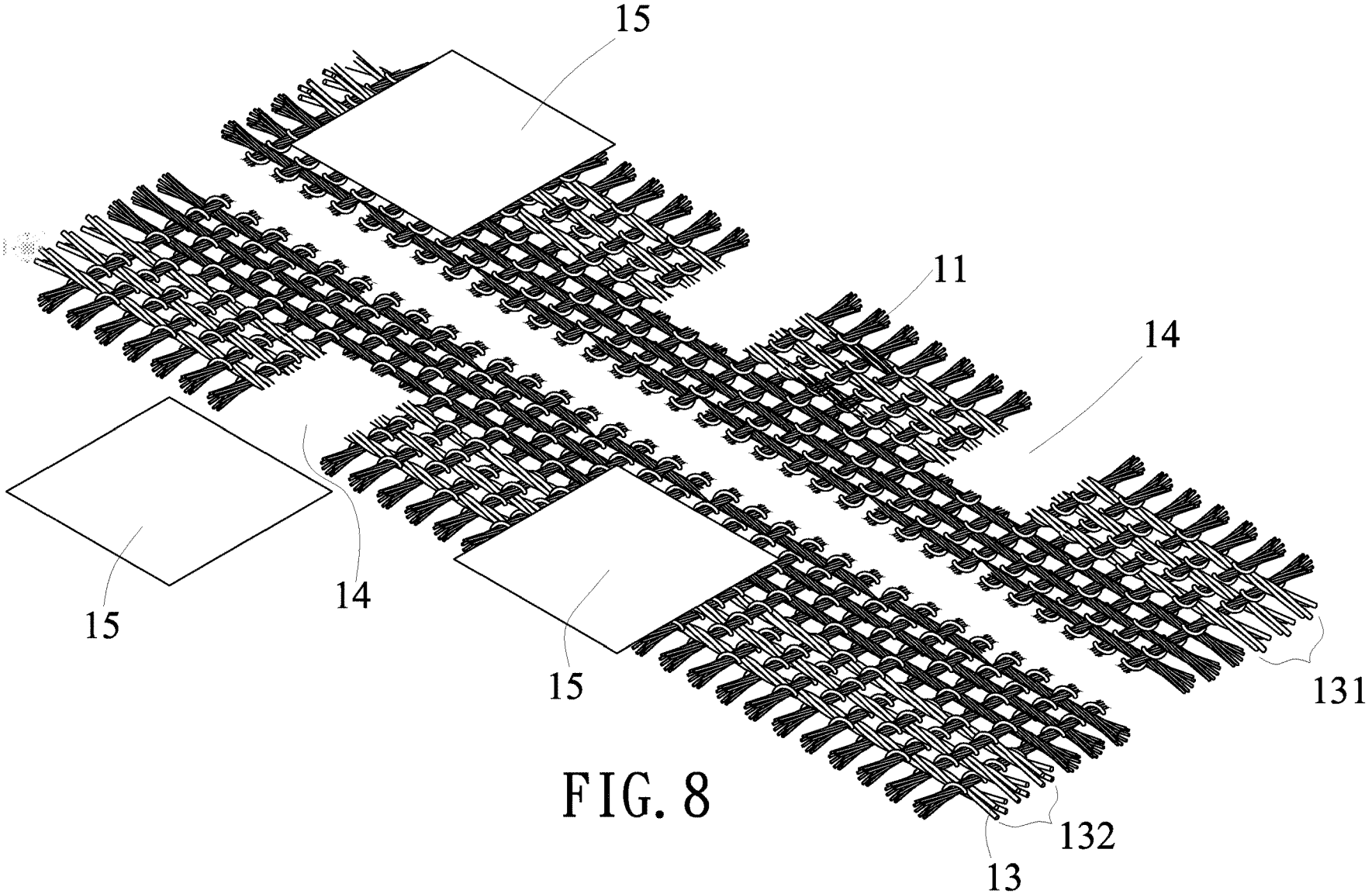
FIG. 8 is a second schematic diagram showing plural insulation elements disposed at plural gaps of an electric heating cloth having gaps.

Referring to FIG. 2 and FIG. 6, the plural metal conductive wires (13) are connected to the fine metal filament (112) of each of the conductive yarn (11) to form the circuit in the electric heating cloth (1) having gaps (14). The fine metal filament (112) is a conductive metal filament and can be made of gold, silver, copper, tungsten, lead, zinc, aluminum, nickel, platinum, palladium, titanium, zirconium, tantalum, molybdenum or an alloy material, wherein the alloy material comprises copper zinc alloy, phosphor bronze, molybdenum alloy, copper nickel alloy, copper nickel zinc alloy, copper nickel silicon alloy, copper nickel tin alloy, copper chromium alloy, copper silver alloy, nickel chromium alloy, beryllium copper alloy, copper tungsten alloy, titanium alloy, nickel chromium molybdenum tungsten alloy, tungsten alloy, zirconium alloy, nickel alloy or stainless steel. The diameter of the fine metal filament (112) is preferably ranging from 0.01 mm to 0.12 mm. The plural metal conductive wires (13) are made of copper, silver or other conductive metal materials or conductive alloy materials. The plural textile yarns (12) are non-conductive yarns.

Referring to FIG. 1, FIG. 2, FIG. 7 and FIG. 8, the plural metal conductive wires (13) are aligned at external sides of the plural textile yarns (12) to form the first conductive side (131) and the second conductive side (132) respectively. Each of the first conductive side (131) and the second conductive side (132) has plural gaps (14) for interrupting electrical current transmitting through the first conductive side (131) and the second conductive side (132). The shape of the plural gaps (14) is unlimited and each of the plural gaps (14) is further provided with an insulation element (15) by sawing or pasting. The area of the insulation element (15) is larger than the area of each of the plural gaps (14) to prevent a short circuit situation caused by connecting of the plural metal conductive wires (13) on two sides of the gap (14).

Referring to FIG. 2 and FIG. 3, the first conductive side (131) has an odd number of gaps (14), and the second conductive side (132) has an even number of gaps (14), e.g., the first connective side (131) has 1 gap, 3 gaps, 5 gaps, or 7 gaps (14), and the second connective side (132) has 2 gaps, 4 gaps, 6 gaps, or 8 gaps (14). In FIG. 2 and FIG. 3, the first connective side (131) has 3 gaps (14) and the second connective side (132) has 2 gaps (14).

In FIG. 3, after turning on the power supply (5), the electrical current is transmitted from the export wire (51) to the connection port (4), and then transmitted to a first end (133) of the first connective side (131) of the electric heating cloth (1) having gaps (14). The electrical current transmission path in the electric heating cloth (1) having gaps (14) is demonstrated by hollow arrows in the FIG. 3 and shortly described below: first, the electrical current is transmitted to the first gap (141) at the first conductive side (131) in a first current direction (71); second, the electrical current is transmitted to the second conductive side (132) in a second current direction (72) by the conductive yarns (11); third, the electrical current is transmitted in a third current direction (73) to the second gap (142) at the second conductive side (132); fourth, the electrical current is transmitted to the first conductive side (131) in a fourth current direction (74); and at last, the electrical current is exported from a second end (134) of the first conductive side (131). In summary, the plural gaps (14) at the first conductive side (131) and the second conductive side (132) of the electric heating cloth (1) having gaps (14) can guide electrical current direction for forming plural circuit connected in series inside the electric heating cloth a) having gaps (14). As shown in FIG. 3, the electric heating cloth a) having gaps (14) of the present invention is transmitted in the directions indicated by the hollow arrows to form a 6-segment series circuit.

Figure 9:
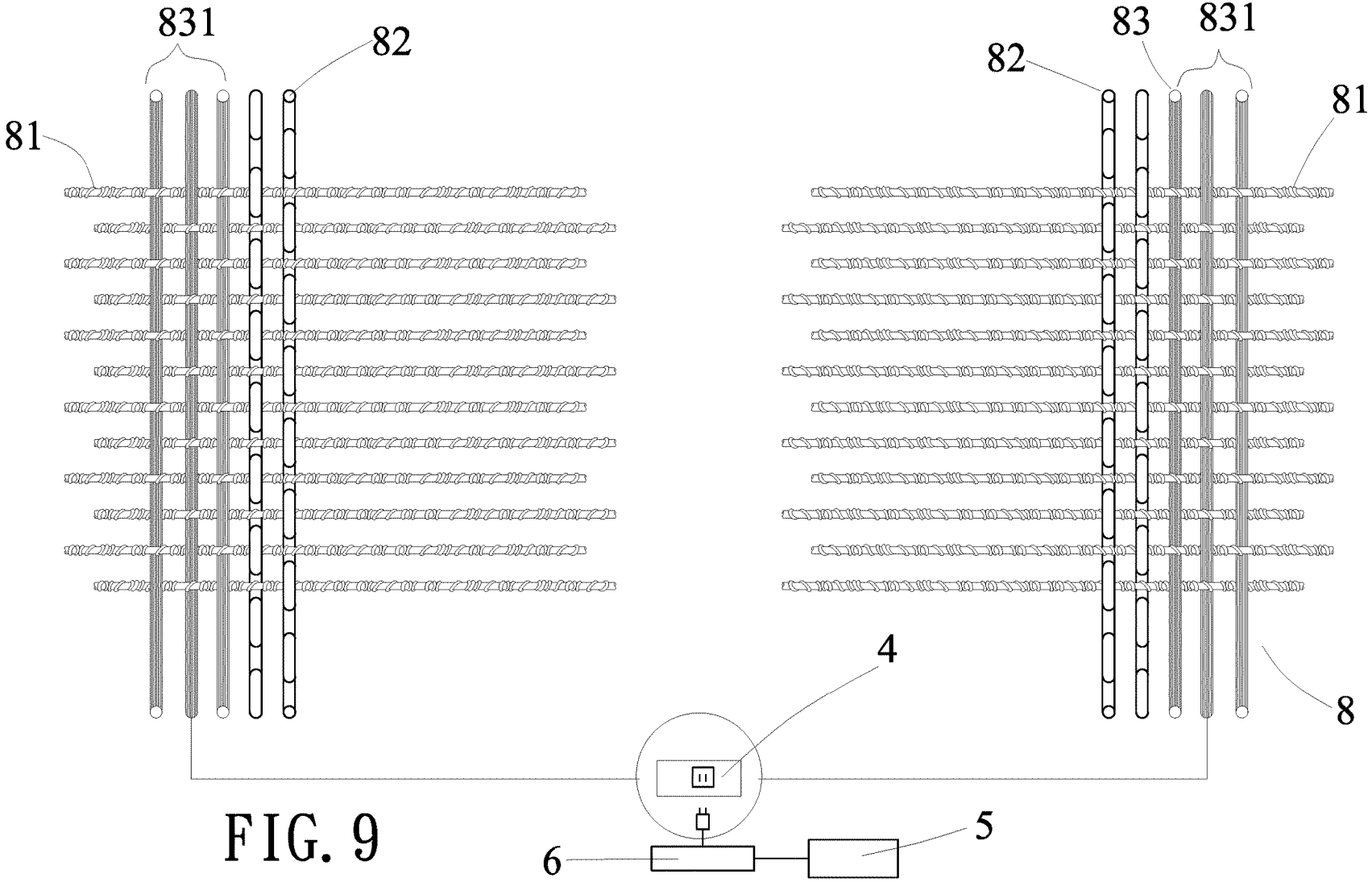
FIG. 9 (PRIOR ART)
FIG. 9 is a schematic diagram showing an electric heating cloth without gaps of a prior art.

In the present invention, a safety voltage used for heating to a preferable temperature is ranging 6 volts to 12 volts. In FIG. 3, if a total voltage provided to the electric heating cloth (1) having gaps (14) having a 6-segment series circuit by the power supply (5) is 48 volts, the voltage across each segment of the 6-segment series circuit is 8 volts which fall within the scope of the safety voltage so as to achieve a safety heating temperature without making the fine metal filament (12) overheat. In addition, a benefit of saving electricity is also achieved. FIG. 9 showed an electric heating cloth a) without gaps which is also interwoven by plural conductive yarns (81), plural textile yarns (82) and plural metal conductive wires (83). The electric heating cloth (8) without gaps has no any gaps in two conductive sides (831), so only one segment of circuit is generated after turning on the power supply (5). When a total voltage provided by the power supply (5) is 48 volts, the voltage across the electric heating cloth (8) without gaps is also 48 volts and leading to consume more watts of heat energy and more electricity.

Therefore, the electric heating cloth (1) having gaps (14) of the present invention can be heated to a preferable temperature at a lower voltage and a lower electrical current by connecting plural circuits with lower voltage (e.g., 8 volts mentioned in FIG. 3) in series in the electric heating cloth (1) having gaps (14), and a benefit of saving electricity is achieved compared to the prior art electric heating cloth al without gaps. It is worth noting that the number of the circuits connected in series in the electric heating cloth (1) having gaps (14) is not limited to the 6 segments shown in FIG. 3. The number of the circuits connected in series is altered by adjusting the number of gaps (14) at the first conductive side (131) and the second conductive side (132) based on a total voltage provided by the power supply (5) and a safety voltage across each segment of the circuit. In conclusion, the electric heating cloth having gaps and its connection structure which connects the electric heating cloth having gaps in series or in parallel and fixed on the fixing lining cloth of the present invention, can be heated after electrifying. The electric heating cloth having gaps is interwoven by plural conductive yarns as warps and plural textile yarns and plural metal conductive wires as wefts, and plural gaps are generated at two conductive sides of the electric heating cloth having gaps. The plural gaps can interrupt electrical current transmitting after electrifying and yield a circuit connected by plural segments in series in the electric heating cloth having gaps. Therefore, the present invention can be heated to a predetermined temperature at a lower voltage after electrifying for saving electricity.

What is claimed is:

1. An electric heating cloth having gaps, comprising plural conductive yarns arranged in a first direction, and plural textile yarns and plural metal conductive wires arranged in a second direction for interweaving with the conductive yarns, wherein the plural metal conductive wires are aligned at external sides of the plural textile yarns form a first conductive side and a second conductive side respectively, and wherein each of the first conductive side and the second conductive side has plural gaps, each of the plural gaps being provided with an insulation element, wherein an area of the insulation element is larger than an area of each of the plural gaps.

2. The electric heating cloth having gaps as claimed in claim 1, wherein the first conductive side has an odd number of gaps, and the second conductive side has an even numbered of gaps.

3. The electric heating cloth having gaps as claimed in claim 1, wherein each of the plural conductive yarns comprises a plurality of filaments and a fine metal filament winding around the plurality of filaments.

4. The electric heating cloth having gaps as claimed in claim 1, wherein each of the plural conductive yarns comprises a plurality of filaments, a fine metal filament winding around the plurality of filaments in a first direction, and a bundle of non-conductive filaments having a diameter ranging from 0.01 mm to 0.12 mm and winding around the plurality of filaments in a second direction opposite to the first direction, wherein the plurality of filaments and the bundle of non-conductive filaments are made of a plurality of non-conductive long fibers, a plurality of non-conductive short fibers or a plurality of non-conductive blending fibers comprising long fibers and short fibers, wherein the plurality of non-conductive long fibers, the plurality of non-conductive short fibers, or the plurality of non-conductive blending fibers are synthetic fibers comprising nylon, olefin, acrylic fiber, polyester fiber, spandex, polyethylene terephthalate fiber, Orlon, Dacron, protein fiber, elastic fiber, carbon fiber and glass fiber.

5. The electric heating cloth having gaps as claimed in claim 3, wherein the fine metal filament is made of gold, silver, copper, tungsten, lead, zinc, aluminum, nickel, platinum, palladium, titanium, zirconium, tantalum, molybdenum or an alloy material, wherein the alloy material comprises copper zinc alloy, phosphor bronze, molybdenum alloy, copper nickel alloy, copper nickel zinc alloy, copper nickel silicon alloy, copper nickel tin alloy, copper chromium alloy, copper silver alloy, nickel chromium alloy, beryllium copper alloy, copper tungsten alloy, titanium alloy, nickel chromium molybdenum tungsten alloy, tungsten alloy, zirconium alloy, nickel alloy or stainless steel, wherein the fine metal filament has a diameter ranging from 0.01 mm to 0.12 mm.

6. The electric heating cloth having gaps as claimed in claim 4, wherein the fine metal filament is made of gold, silver, copper, tungsten, lead, zinc, aluminum, nickel, platinum, palladium, titanium, zirconium, tantalum, molybdenum or an alloy material, wherein the alloy material comprises copper zinc alloy, phosphor bronze, molybdenum alloy, copper nickel alloy, copper nickel zinc alloy, copper nickel silicon alloy, copper nickel tin alloy, copper chromium alloy, copper silver alloy, nickel chromium alloy, beryllium copper alloy, copper tungsten alloy, titanium alloy, nickel chromium molybdenum tungsten alloy, tungsten alloy, zirconium alloy, nickel alloy or stainless steel, wherein the fine metal filament has a diameter ranging from 0.01 mm to 0.12 mm.

7. The electric heating cloth having gaps as claimed in claim 1 is furthered electrically connected with a power supply.

8. The electric heating cloth having gaps as claimed in claim 7, wherein the power supply is electrically connected to a temperature controlling element to regulate the temperature of the electric heating cloth having gaps.

* * * * *